US006953225B2

(12) United States Patent
Gallagher et al.

(10) Patent No.: US 6,953,225 B2
(45) Date of Patent: Oct. 11, 2005

(54) DUAL HARDNESS SKATEBOARD WHEEL

(76) Inventors: Kenny A. Gallagher, 9248 Leroy Rd., Corona, CA (US) 92883; Victor K. Katsuyama, 25322 Desalle, Laguna Hills, CA (US) 92653

( * ) Notice: Subject to any disclaimer, the term of this patent is extended or adjusted under 35 U.S.C. 154(b) by 0 days.

(21) Appl. No.: 10/429,523

(22) Filed: May 2, 2003

(65) Prior Publication Data

US 2004/0217644 A1 Nov. 4, 2004

(51) Int. Cl.[7] ..... B60B 5/02
(52) U.S. Cl. ..... 301/5.308; 301/5.304
(58) Field of Search ..... 301/5.301, 5.302, 301/5.304, 5.308

(56) References Cited

U.S. PATENT DOCUMENTS 279,406 A * 6/1883 Mansfield ..... 301/5.309
2,878,071 A * 3/1959 Fowlkes ..... 301/5.309
5,129,709 A * 7/1992 Klamer ..... 301/5.302
5,320,418 A * 6/1994 Chen ..... 301/5.308
5,401,037 A * 3/1995 O'Donnell et al. .... 280/11.204
5,725,284 A * 3/1998 Boyer ..... 301/5.302

* cited by examiner

*Primary Examiner*—Russell D. Stormer
(74) *Attorney, Agent, or Firm*—Leonard Tachner

(57) ABSTRACT

A multi-element skateboard wheel having at least two different hardness surfaces including a softer center exterior surface and a harder side exterior surface. The softer center surface is the principal weight supporting surface which, because of its lower durometer material provides a quieter and smoother ride and better traction than conventional skateboard wheels. The harder side surface, which in the preferred embodiment is positioned on each side of the wheel, comprises a higher durometer material which exhibits less frictional resistance to sliding engagement with vertical surfaces such as curbs and with high inclines and the like. Moreover, in the preferred embodiment, the harder side surfaces extend around to the radial surface of the wheel at the precise same radial height as the softer center surface.

14 Claims, 3 Drawing Sheets

DUAL HARDNESS SKATEBOARD WHEEL

BACKGROUND OF THE INVENTION

1. Field of the Invention

The present invention relates generally to the field of skateboard wheels and more specifically to a multi-element skateboard wheel having at least two different hardness surfaces including a softer center exterior surface and a harder side exterior surface.

2. Background Art

A skateboarder generally comes to a stop by either dragging a foot on the ground or by lowering the tail of the board to the ground and dragging the wood of the tail portion of the board on the riding surface.

Skateboard wheels have a wide surface engaging the ground. Skateboarders do not use round or parabolic wheels. The flat section of a skateboard wheel is anywhere from ⅜" to over 2" in width depending on the type of skating the individual prefers.

Thinner wheels are usually made of harder urethanes for skateboarders that like to do a lot of sliding tricks. They prefer a smaller footprint and harder urethane so that they can turn their boards sideways and slide with the board perpendicular to their momentum. This is a very popular trick called a "power slide".

Fatter wheels are made with softer urethane for a smoother ride and more control, used by recreational skateboarders that do a type of skateboarding referred to as carving, where the skateboarders make subtle turns back and forth with their skateboard to propel themselves forward without placing their foot on the ground. Other types of skateboarding done on these wider wheels would be downhill racing and slalom racing where high speeds are attained and control is important to safety and success.

Softer wheels are slower but give more control because of a higher coefficient of friction. Hard wheels are fast but lack control because of a lower coefficient of friction.

Skateboarders are forced to compromise between speed and control. Giving the skateboarder a dual surface would eliminate the compromise. A design having both hard and soft urethanes in constant contact with the riding surface would give the rider the benefits of both.

It is important to have the harder urethane on the outside because of the tricks today's skateboarders are doing. When a skateboarder does "power slide", he turns his board sideways with this toe facing forward in the direction he is moving and puts his weight on the heels of his foot and the backside of the board. This lifts or minimizes the pressure and contact of the leading edges of the wheels and allows the skateboarder to slide on the trailing edges. If a skateboarder were to perform this trick on dual durometer wheels, the pressure would be transferred to the trailing outer edge of the wheel which is constructed with the harder urethane with the lower coefficient of friction, allowing the skater to enjoy a slide as if he were on a single urethane wheel of harder durometer and lower friction.

Another favorite trick of the skateboarder is called the grind. This occurs when a skateboarder hops up onto a curb or rail and slides on the trucks of the skateboard in between the wheels. While performing this trick it is not uncommon for the skateboarder to slide on the truck and the inside wall of the wheel. This is done to help stabilize the rider while sliding and is referred to as locking in. The problem that exists with a high coefficient of friction wheel is that it may bite or stick to the surface the skateboarder is grinding. When this happens, the trick comes to an abrupt end throwing the rider from the board. This is another reason for having a low friction surface on the outside.

SUMMARY OF THE INVENTION

The present invention comprises a multi-element skateboard wheel having at least two different hardness surfaces including a softer center exterior surface and a harder side exterior surface. The softer center surface is the principal weight supporting surface which, because of its lower durometer material provides a quieter and smoother ride and better traction than conventional skateboard wheels. The harder side surface, which in the preferred embodiment is positioned on each side of the wheel, comprises a higher durometer material which exhibits less frictional resistance to sliding engagement with vertical surfaces such as curbs and with high inclines and the like. Moreover, in the preferred embodiment, the harder side surfaces extend around to the radial surface of the wheel at the precise same radial height as the softer center surface. In addition, the softer center surface has closely spaced annular ridges to increase traction. This combination and placement of different hardness materials provides for a more confident and higher performance ride during an extreme skateboard maneuver while providing more comfort and better wear characteristics during ordinary skateboard use.

This unique dual durometer skateboard wheel provides advantages over conventional wheels for the following reasons:

1. Single urethane wheels cannot achieve both speed and control to meet the skateboarders needs.

2. Since it is important to the skateboarder to be able to perform the above mention tricks, these tricks dictate that the harder urethane of lower friction properties be on the outside leaving the middle of the wheel to be occupied by higher friction material.

3. With the lower durometer/hardness in the middle, the wheel will tend to expand on compression creating a larger footprint and more control when needed most. One of the current favorite tricks of more advanced skateboarders is to slide down the rail of stairways, ollie their boards up onto the hand rails of stairways and slide down to the bottom and land. They are currently sliding down rails in excess of 20 stairs and landing such tricks very demanding. A single urethane wheel of hard/low friction quality may slide out from under the skater on landing, where as a wheel of soft/high friction urethane may stick on the rail during the slide, launching the skater to injury. The present invention minimizes the chance of both. The skateboarder lands with increased force and speed. At this moment of landing, the wheels are compressed. The invention allows the wheels to stretch wide and grip better at this moment. Since the middle of the wheel is of softer construction, it will tend to expand at the point of least resistance creating a mushroom effect, engaging a higher percentage of high friction material.

4. When traveling in a straight line, the outer sections of the wheel constructed of harder/lower friction materials, do not compress as easily as the inner softer section, so they will tend to ride up on top of a surface instead of conforming to it as a softer urethane would. Because of this feature the rider obtains the speed of a harder wheel.

5. When turning, a different dynamic occurs when side force is applied on a curve. When a skateboarder turns, he tilts the board in the direction he wants to turn (for example, left). He applies downward pressure on the left side of the board with his feet. This causes the trucks (front and back) to turn in on the left side of the board. When this happens on a left banking turn, the left side wheel on the front and back truck move toward the left center of the board while the outside wheels (or right wheels) turn out (front right wheel moves toward the nose of the right side of the board and back right wheel moves toward the right tail side of the board). The load bearing wheels become the inside or left side wheels. These inside wheels also create most of the friction to create the turn. When making this left bank turn, the forces at play are directed at the ground and in the direction of movement. This creates a downward and left-to-right side pressure to the wheel. When this happens, the wheel stretches in the middle because of this force (and the resistance of the outer harder side of the wheel) and engages a higher percentage of high friction material, giving the rider more control then he would have if the center portion was made from low friction material (on the outside of the wheel).

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
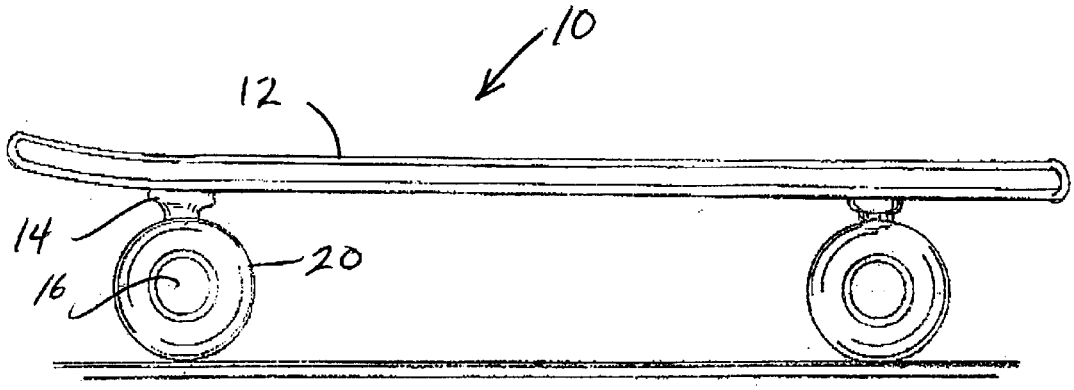
FIG. 1 is a side view of a typical skateboard employing the wheels of the present invention.
Figure 2:
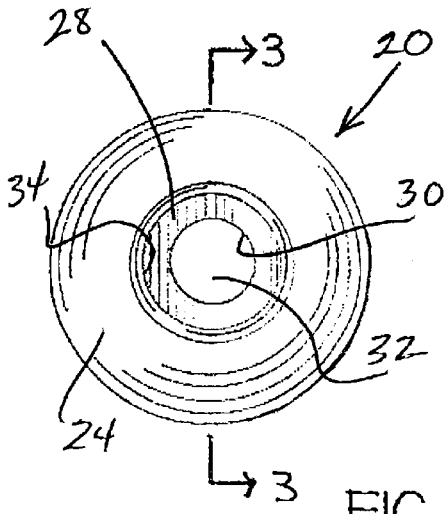
FIG. 2 is a side exterior view of a preferred embodiment of the inventive skateboard wheel.
Figure 3:
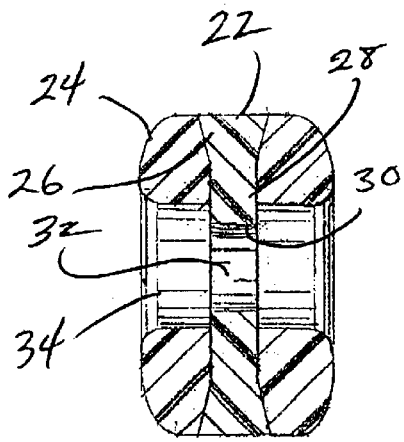
FIG. 3 is a cross-sectional view of the wheel of FIG. 2 taken along lines 3—3 thereof.
Figure 5:
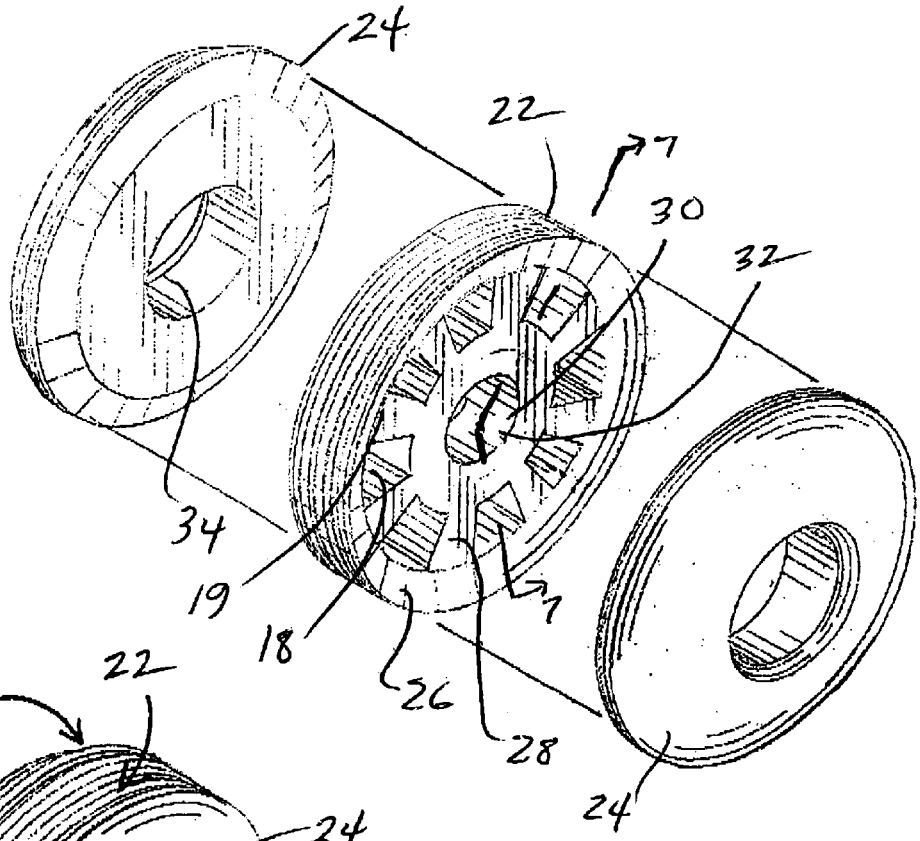
FIG. 5 is an exploded view of the wheel of FIG. 2.
Figure 4:
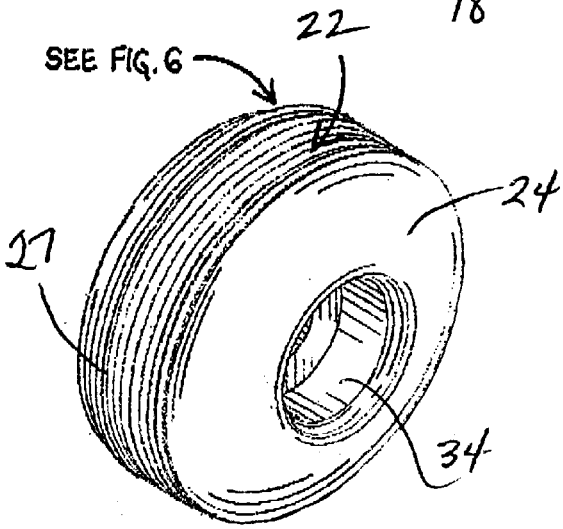
FIG. 4 is a three-dimensional view of the wheel of FIG. 2.
Figure 6:
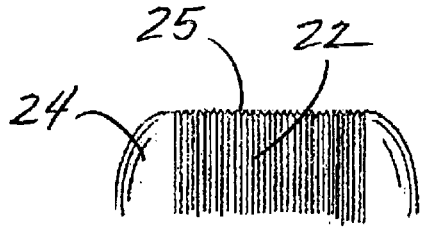
FIG. 6 is an enlarged view of the radial edge of the inventive wheel.

Referring to the accompanying drawings and FIGS. 1–6 initially, it will be seen that a skateboard 10 having a deck 12, wheel trucks 14 and axles 16, also comprises inventive wheels 20. Wheels 20 comprise a center portion 22 and a pair of opposing side portions 24 in the illustrated preferred embodiment. As seen best in FIGS. 3 and 5, the center portion 22 may have a plurality of chambers 18 separated by a plurality of spokes 19 around a hub 28 through which there is a bearing surface 30 and an axle passage 32 through the center of portion 22. A tapered rim 26 extends outwardly to a radical surface 27 which may have annular ridges 25.

Figure 7:
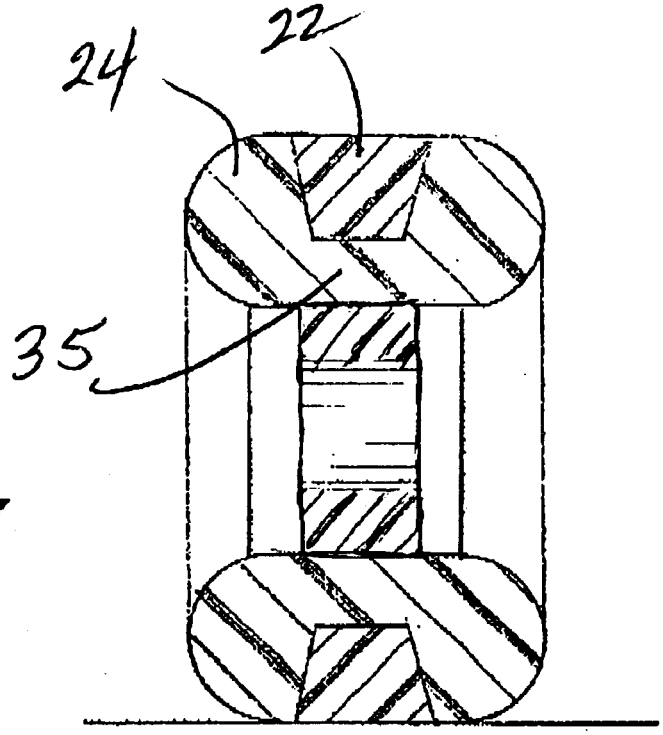
FIG. 7 s a cross-sectional view taken along lines 7—7 of FIG. 5.

Each side portion 24 has central aperture 34. The side portions may optionally by interconnected to one another by bridge members 35 shown in FIG. 7. The bridge members 25 extend through chambers 18 of center portion 22.

Figure 8:
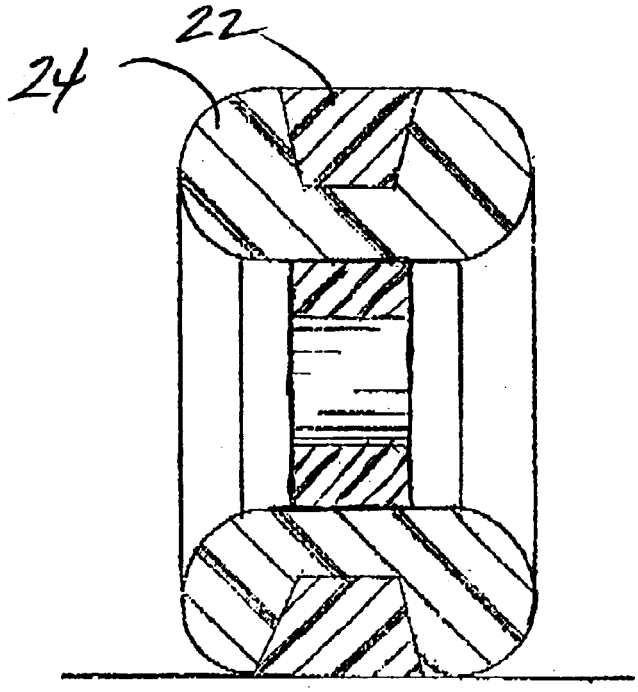
FIG. 8 is a view similar to that of FIG. 7 but taken while the inventive wheel is in a turning mode.

An important aspect of the present invention is the relative hardness of center portion 22 and side portions 24, each of which is preferably formed of a urethane material. Center portion 22 preferably has a hardness in the range of 70 durometer "A" scale to 55 "D" scale. However, side portions 24 have a higher durometer hardness in the range of 90 "A" to "75" D. By way of example, it has been found advantageous to provide a side portion hardness of about 105 "A" while employing a lower hardness of about 98 "A" in the center portion. Because side portions 22 extend to the edges of radial surface 27, they form outer parts of the radial surface that contacts the underlying street surface beneath the skateboard wheels. As shown in FIG. 8, when the wheels 20 are subjected to the stresses of a turn, the softer center portion 22 distorts to provide greater traction while the outer harder side portion 24 is less subject to distortion and helps to maintain the shape of the wheel.

Having thus described a preferred example of the invention, it will be understood that various modifications and additions are contemplated. By way of example, the precise shape of the center and side portions, their relative dimensions and their comparative hardnesses, may be altered while still achieving the advantageous results of the invention. It should also be understood that as used herein the term "hardness" also implies "coefficient of friction". Thus a harder urethane material implies a lower coefficient of friction and a softer urethane material implies a higher coefficient of friction. This invention contemplates achieving different coefficients of friction in ways other than natural hardness. Accordingly, the scope hereof is to be limited only by the appended claims and their equivalents.

We claim:

1. A skateboard wheel comprising a center portion formed of a first material;

and at least one side portion affixed axially to said center portion and being formed of a second material;

the second material having a hardness that is greater than said first material, the center portion having radially dispersed apertures, said second material of said side portion extending through said apertures for being secured to said center portion.

2. The skateboard wheel recited in claim 1 comprising a pair of said side portions affixed axially to opposing axial surfaces and through said apertures of said center portion and each said side portion being formed of said second material.

3. The skateboard wheel recited in claim 1 wherein each of said first and second materials has a hardness in the range of 70 "A" to 105 "A".

4. The skateboard wheel recited in claim 1 and having a radial surface formed by both said center portion and said at least one side portion.

5. The skateboard wheel recited in claim 1 where said first and second materials comprise urethane.

6. A skateboard wheel having an annular radial surface and opposing axial surfaces, wherein said radial surface comprises a first material and said axial surfaces comprise a second material, said second material being harder than said first material, said axial surfaces being integral to one another through apertures in said radial surface.

7. A skateboard wheel having an annular radial surface and opposing axial surfaces, wherein said radial surface comprises a first material and at least one of said axial surfaces comprises a second material, said second material having a lower coefficient of friction than said first material, said axial surfaces being integral to one another through apertures in said radial surface.

8. The skateboard wheel recited in claim 7 wherein said first material has a hardness of about 98 "A" durometer and said second material has a hardness of about 105 "A" durometer.

9. The skateboard wheel recited in claim 7 wherein said first and second materials have a hardness in the range of about 70 "A" durometer to about 105 "A" durometer.

10. The skateboard wheel recited in claim 7 wherein said radial surface comprises a center portion and at least one outer portion, said center portion being formed of said first material and said outer portion being formed of said second material.

11. A skateboard wheel comprising a center portion formed of a first material; and at least one side portion affixed axially to said center portion and being formed of a second material; the second material having a coefficient of friction that is smaller than said first material, said center portion having radial dispersed apertures and said side portion extending through said apertures.

12. The skateboard wheel recited in claim 11 comprising a pair of side portions affixed axially to opposing axial surfaces of said center portion and each being said side portion formed of said second material, and each said side portion having integral connections to the other said side portion through said apertures.

13. The skateboard wheel recited in claim 11 and having a radial surface formed by both said center portion and said at least one side portion.

14. The skateboard wheel recited in claim 11 where said first and second materials comprise urethane.

* * * * *